US007832022B1

(12) United States Patent
Peters

(10) Patent No.: US 7,832,022 B1
(45) Date of Patent: Nov. 16, 2010

(54) PANTS APPARATUS AND METHOD OF USE

(76) Inventor: Brian Jeffery Peters, 7052 Moonlight Cir., Huntington Beach, CA (US) 92647

( * ) Notice: Subject to any disclaimer, the term of this patent is extended or adjusted under 35 U.S.C. 154(b) by 477 days.

(21) Appl. No.: 11/601,249

(22) Filed: Nov. 18, 2006

(51) Int. Cl.
*A41D 1/06* (2006.01)
*A41D 13/02* (2006.01)

(52) U.S. Cl. ..... 2/227

(58) Field of Classification Search ..... 2/69, 2/23, 24, 62, 79, 227, 232, 233, 919; D2/742, D2/747, 860
See application file for complete search history.

(56) References Cited

U.S. PATENT DOCUMENTS 1,885,527 A * 11/1932 Luft ..... 2/227
2,483,136 A 9/1949 Hamman
3,761,962 A * 10/1973 Myers ..... 2/79
4,613,991 A 9/1986 Grover
4,843,654 A 7/1989 March
D317,074 S * 5/1991 Beasley ..... D2/742
5,109,546 A 5/1992 Dicker
5,416,928 A 5/1995 Koenig
5,956,775 A 9/1999 Ezra
6,119,274 A 9/2000 Graham
6,253,377 B1 7/2001 Lascala
6,263,510 B1 * 7/2001 Bay et al. ..... 2/93
6,339,845 B1 * 1/2002 Burns et al. ..... 2/243.1
D460,241 S 7/2002 Linicomn, Jr.
6,477,716 B2 11/2002 Blaire
D469,241 S 1/2003 Moore
D469,596 S 2/2003 Schneider
D469,946 S 2/2003 Hansen et al.
6,611,964 B2 9/2003 Lipsett et al.
D485,049 S * 1/2004 Newson ..... D2/742
2005/0246819 A1 11/2005 Tucker

* cited by examiner

*Primary Examiner*—Gary L Welsh
*Assistant Examiner*—Amber R Anderson
(74) *Attorney, Agent, or Firm*—Mind Law Firm; Justin G. Sanders; Jeromye V. Sartain

(57) ABSTRACT

Pants comprising an upper portion formed of a first material such as denim and a lower portion formed of a second material such as leather and connected to the upper portion along at least one seam. An inseam panel is sewn along at least one lengthwise edge of the pants spanning both the upper portion and the lower portion. At least one vent assembly may be installed in each lower portion of the pants, each vent assembly comprising a means for selectively closing the vent assembly, a cover panel formed so as to selectively cover the closure means, and an interior panel formed beneath the closure means and configured to allow air to pass therethrough upon opening of the closure means. A permanent or selectively removable lining may be installed within the lower portion of the pants, and protective armor may be installed on the pants.

19 Claims, 7 Drawing Sheets

2
30
28
26
32
20
34
34
22
24
10
50
60
62
40
42
70
72
2
41

2/7
30
30'
20
28
28
60
50
46
44
10
60
62
46
40
72
70
74
41
76
28'
28'
20'
50'
60'
28'
60'
10'
28'
44'
62'
40'
72
70
74
41'
76

28"
20"
60"
50"
2D
46"
10"
40"
70

58
50"
62"
28"
60"
52
44"
56
46"
54

6
120
110
150
160
162
140
190
142
170
194
192
190
6

PANTS APPARATUS AND METHOD OF USE

INCORPORATION BY REFERENCE

Applicant hereby incorporates herein by reference any and all U.S. patents and U.S. patent applications cited or referred to in this application.

BACKGROUND OF THE INVENTION

1. Field of the Invention

Aspects of this invention relate generally to pants, and more particularly to pants with functional features suited to motorcycle and horseback riding and the like.

2. Description of Related Art

The following art defines the present state of this field:

U.S. Pat. No. 2,483,136 to Hamman et al. discloses rain chaps used to protect the trousers or hose of the wearer against rain, snow and the splashing of water from puddles.

U.S. Pat. No. 4,613,991 to Grover is discloses a pair of fabric work pants particularly designed for kneeling work activity having removable leather patches covering the knee area and a depending portion of each pant leg. Containment spaces are formed between the patches and the underlying fabric for holding padding material for protection of the user's knees. Leather utility pockets are also shown for the pants. The leather patches and the utility pockets are releasably attached to the work pants to facilitate laundering of the underlying fabric garment without damaging the leather. A further comfort feature of the pants comprises a fabric insert in the nature of a crotch gusset.

U.S. Pat. No. 4,843,654 to March discloses cold weather riding pants formed of a basic pants structure of a composite of an outer fabric, an intermediate layer of thermal insulation and an inner lining inside of the riding pants. A biaxially stretchable elastic insert is positioned along the outside side of each leg pant as well as in the upper portion of the seat of the pants. A frictional material insert is secured along the inside side of each leg pant together with an adjustable stirrup along the bottom of each leg pant. A pant leg zipper and/or an adjustable strap for gathering the lower portion of each leg pant is used to provide lower pant leg opening adjustment.

U.S. Pat. No. 5,109,546 to Dicker discloses an exercise suit which has a pair of stretchable pants (20) and a pull-over top (44) with a lower body reinforcing segment (38) attached, in the middle only, to the pants and an upper body reinforcing collar (54) attached, in the middle only, to the top. A leg band (42) encircles the legs (24) and the side bands (58) are affixed to the respective reinforcing collar. The leg bands (42) grip the wearer's feet creating a continuous loop from the waist to the feet. Hook and loop tape (40) allow the reinforcing segment (38) to be adjusted in tension around the wearer's waist and similarly adjusted knee pads (32) cover the knees in the pants legs (24). The resilience of the suit combined with the looped bands create a resistance to movement providing exercise to the wearer's muscles during physical activity.

U.S. Pat. No. 5,416,928 to Koenig discloses a versatile garment attachment and article of clothing, which consists of a decorative flexible panel. A garment is worn on a portion of a body of a person. A structure is for attaching in a removable manner the decorative flexible panel to the garment, to create a plurality of different wearable styles for the garment. Components can also be provided for connecting in a removable manner the decorative flexible panel to itself or to a second decorative flexible panel, to create a plurality of different wearable styles.

U.S. Pat. No. 5,956,775 to Ezra discloses a combination pair of jeans and a metallic ornamentation. A substantially rectangular metallic ornament is affixed to a rear portion of a waistband of a pair of conventional jeans in place of the conventional leather label. The metallic ornament may be riveted to the waist band or it may be adhered to a leather strip which is in turn sewn onto the waistband. A plurality of metallic belt loops may also be provided and attached to the waistband in a similar fashion. The metallic ornament is made of a lustrous material providing an enhanced appearance. The metallic ornament may be engraved with a specific pattern, logo or other text. The metallic ornament may also be formed of a metal anodized to a specific color.

U.S. Pat. No. 6,119,274 to Graham discloses a pair of full chaps formed of a substantially inelastic material, and having strips of elastomeric fabric interposed between the teeth of the closing zipper and the edges of the chaps material, to facilitate a continuous form-fit of the chaps no matter how the legs of the wearer flex. Additionally, elastomeric gussets are fixed across cut-outs in the chaps, also to accommodate and insure a maintained form-fit.

U.S. Pat. No. 6,253,377 to Lascala discloses an improved pair of chaps (15) for use by a rider when riding a horse. In the preferred embodiment, the chaps are comprised of two leg portions (16, 18), an upper portion (19), the upper portion having a yoke portion (20), the yoke portion having a waist belt (21), whereby the chaps may be worn without trousers and provide protection to the rider. The invention discloses that each leg portion may have an off-center seam (22) and the seam may be set off-center (23) by one half inch. Each leg portion may include a snap connection (24) for raising the lower part of the leg portion. The waist belt may comprise belt tips (26) adapted for use with a buckle set, or the waist belt may include a concho (27). The yoke portion may include an inner pocket (28) and each leg portion may include a boot contour (29) and/or fringe (30).

U.S. Pat. No. D460,241 to Linicomn, Jr. discloses an ornamental design for woven jeans.

U.S. Pat. No. 6,477,716 to Blaire discloses uniform pants. The pants are particularly well suited for persons in law enforcement, the military, security, construction and the like as well as medical patients and senior citizens who desire easier access, convenience and safety when attending to their restroom needs. The pants comprise: a) a waistband; (b) two leg members extending from the waistband; (c) a continuous fastener member positioned along the inseam of the leg members, wherein the fastener member begins at a point above the bottom edge of one leg member and extends upwardly and through the crotch area and then downwardly along the second leg member and ends at a point above the bottom edge of the second leg member; and wherein the positioning of the fastener member creates an opening between the bottom edge of the inseam and the fastener member on each leg member; and (d) a separate protective shield positioned beneath the full length of the fastener member. Fastener members include zippers, snaps, buttons, hooks, and hook and loop type fasteners. The zipper is of the regular, visible or invisible type when positioned inside the pants. Additionally, the inclusion of a continuous outer flap on top of the fastener member functions to conceal the fastener member from view. This outer flap is unnecessary when an invisible type zipper is used as the fastener member.

U.S. Pat. No. D469,241 to Moore discloses an ornamental design for chaps.

U.S. Pat. No. D469,596 to Schneider discloses an ornamental design for a pair of chaps.

U.S. Pat. No. D469,946 to Hansen et al. discloses an ornamental design for jeans.

U.S. Pat. No. 6,611,964 to Lipsett et al. discloses a product and process involving pants having customized bands or stripes at their sides. The pants include gaps extending down the sides of the legs. A decorative band fits within the gap and is attached by continuous fasteners, such as zippers and/or discrete fasteners, such as snaps. The process comprises acquiring a relatively small inventory of pants of different sizes, acquiring a relatively large inventory of decorative bands of different colors and/or designs, and receiving and fulfilling orders for the customized pants by inserting and attaching the bands within the gaps as needed to fulfill orders.

U.S. Patent Application Publication No. 2005/0246819 to Tucker discloses a clothing system including an overtrouser and an undertrouser to be worn under the overtrouser, wherein the undertrouser is configured such that, when the system is worn, the undertrouser may be removed without removing the overtrouser.

The prior art described above teaches rain chaps, work pants, riding pants, an exercise suit with resilient reinforcing, a versatile garment attachment and article of clothing, combination jeans and a metallic ornament, an article of apparel comprising an improved pair of chaps, woven jeans, easy opening pants, chaps, a pair of chaps, jeans, selective pants and bands for customized assembly, and a clothing system and method, but does not teach pants with integral leather sections, selectively openable leg vents, a removable liner, or protective armor suited to motorcycle and horseback riding and the like. Aspects of the present invention fulfill these needs and provide further related advantages as described in the following summary.

SUMMARY OF THE INVENTION

Aspects of the present invention teach certain benefits in construction and use which give rise to the exemplary advantages described below.

In a first aspect of the invention, an upper portion of a pair of pants is formed of a first material, a lower portion is formed of a second material and connected to the upper portion along at least one seam, and an inseam panel is sewn along at least one lengthwise edge of the pants apparatus spanning both the upper portion and the lower portion.

In a further aspect of the invention, the first material, or the material of which the upper portion of the pants is constructed, is denim, and the second material, or the material of which the lower portion of the pants is constructed, is leather.

In a further aspect of the invention, the upper portion of the pants comprises an upper front panel and an upper rear panel sewn together to form a seat section of the pants, the to lower portion comprises two lower front panels and two lower rear panels, each lower front panel being sewn to a respective lower rear panel so as to form one of two leg sections of the pants, each of the leg sections being sewn to the seat section along a seam that is substantially horizontal with a slight downward curve from the inseam panel toward a groin section of the pants.

In a further aspect of the invention, at least one vent assembly is installed in each lower portion of the pants substantially along the inseam panel, each vent assembly comprising a means for selectively closing the vent assembly formed integrally with the inseam panel, a cover panel formed so as to selectively cover the closure means, and an interior panel formed beneath the closure means and configured with perforations to allow air to pass therethrough upon opening of the closure means.

In a further aspect of the invention, a lining is installed substantially beneath the lower portion of the pants.

In still a further aspect of the invention, the lining further comprises at least two spaced-apart, selectively openable straps formed about an upper end of the lining, a first end of each strap being attached to the upper end of the lining, a first engagement device attached to the strap at the first end, an opposite second end of each strap formed with a second engagement device configured to selectively engage the first engagement device, and at least two loops sewn in spaced apart relationship along the seam between the upper portion and the lower portion of the pants, whereby each strap may be passed through the corresponding loop and the first and second engagement devices engaged to attach the lining to and substantially suspend the lining within the lower portion.

In yet a further aspect of the invention, protective armor is formed integral with the pants.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Aspects of the present invention are generally directed to a new and useful pants design incorporating leather or other such material so as to form what is effectively a combination pants and chaps garment that offers its wearer the comfort and protection necessary while riding a motorcycle, horseback or the like, yet being in the form of a single garment that can by stylishly and comfortably worn even when not riding, thereby avoiding the inconvenience of multiple garments that must be added or removed in layers or be changed depending on the context. While particular embodiments of the invention are shown and described, those skilled in the art will appreciate that the invention is not so limited. Rather, though a particular size and cut of pants is shown, for example, it will be appreciated that numerous other sizes and cuts are possible without departing from the spirit and scope of the invention. Specifically, while the pants are shown herein as having generally a straight cut, it will be appreciated that a boot cut or flared cut may also be employed, for example. Moreover, while the terms "pants" and "chaps" are used throughout, it will be further appreciated that the garment can take on numerous forms, including but not limited to forms in which the leather or other such material is incorporated into the pants in a manner that does not resemble "chaps" as that term is generally defined. Rather, aspects of the present invention may include, but are not limited to, incorporation of leather or other such materials into a pants-type garment in a variety of configurations so as to offer the wearer the comfort and protection needed while riding along with the convenience of a single garment and/or incorporation in such a garment of selectively openable leg vents and/or a removable liner.

Figure 1:
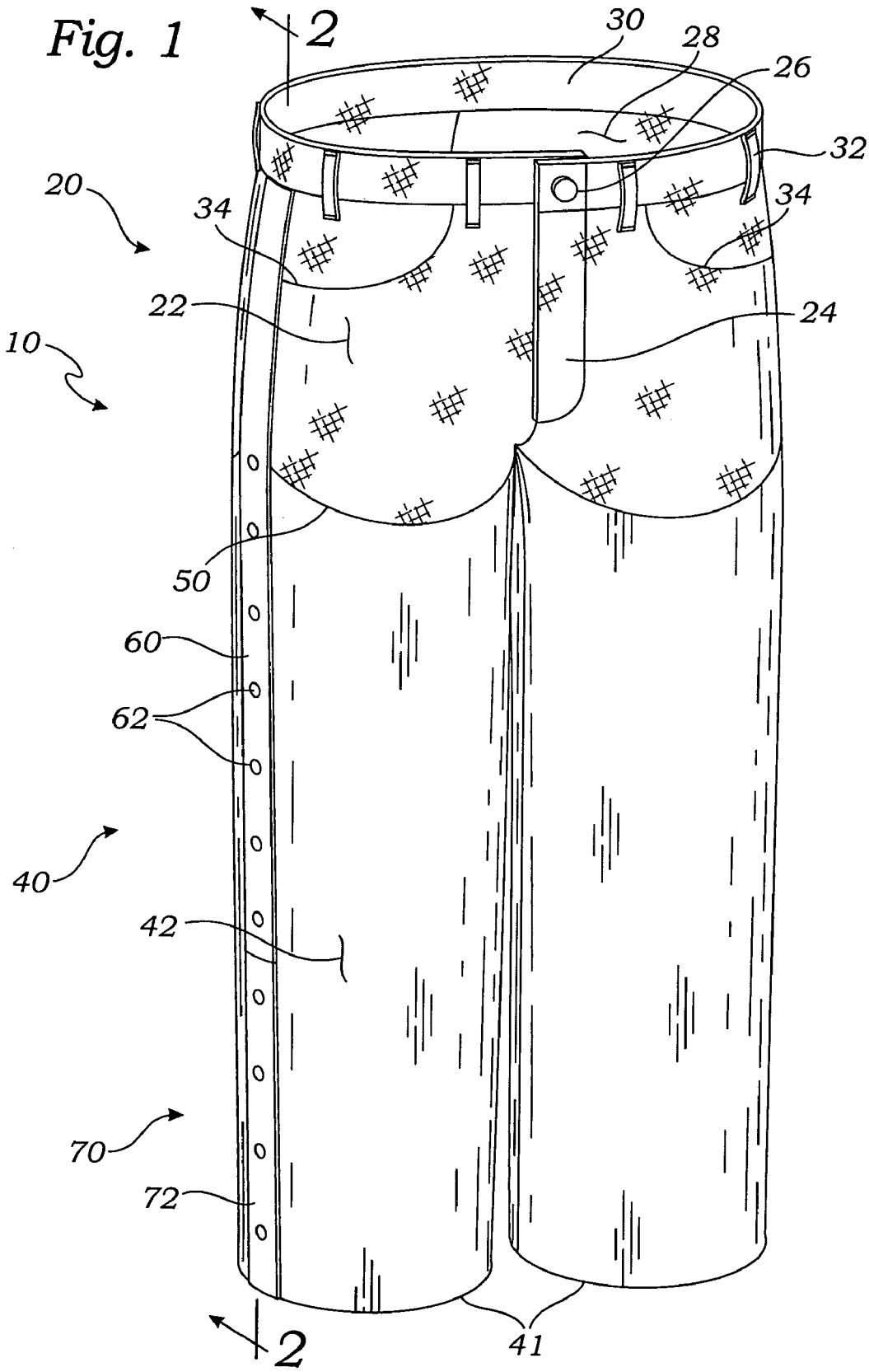
FIG. 1 is a perspective view of an exemplary embodiment of the invention.

Turning first to FIG. 1, there is shown an exemplary embodiment of the pants 10 of the present invention as comprising an upper portion 20 and lower leg portions 40. While the portions 20, 40 are shown as generally being joined along curved, horizontal seams 50 extending downwardly from opposite inseams toward the groin section of the pants 10, it will be appreciated that the location and configuration of the seams 50 can vary and that the seams 50 shown and described are merely for illustration. In other embodiments, it may be preferable, for example, that the seams be substantially in the vicinity of the knees. Depending on the context or intended use, each such portion 20, 40 may be constructed of virtually any fabric or material now known or later developed. For the specific context of motorcycle riding, the present exemplary embodiment entails pants 10 in which the upper portion 20 is constructed of denim material and the leg portions 40 are constructed of leather covering virtually all of the wearer's legs up to the groin area, which construction has certain advantages in use as explained more fully below. Such leather may be a rawhide, suede, deerskin, elk skin, pigskin, sheepskin, or any other such material. It will be appreciated that deerskin and elk skin may be advantageous in some applications because these materials are known in the art to be hand washable. In addition to such leathers, the lower leg portions 40 may also be formed of any other natural or synthetic material having the necessary toughness, wearability and workability. Moreover, while in the exemplary embodiment the upper portion 20 is formed of denim and the lower portion 40 is formed of leather, it will be appreciated that a wide variety of materials now known or later developed may be employed instead, in whole or in part. For example, synthetic materials having a nylon, polyester or other such fabric base along with other suitable additives to give the material abrasion or puncture resistance, flame resistance, water or weather proof performance, or other such properties may be employed alone or in combination with other materials in the upper or lower portions 20, 40. One such exemplary material is SuperFabric® from HDM, Inc. Or, it will be further appreciated that the upper or lower portions 20, 40 may be treated for water proofing as by ScotchGard® or the like. The upper portion 20 may be otherwise constructed in a typical manner so as to define a seat section having an upper front panel 22 having a fly 24 with closure 26, an upper rear panel 28, and a waist band 30 with belt loops 32. The upper portion 20 may also have one or more pockets 34. In the exemplary embodiment wherein the upper portion is denim or some other material not particularly known for being water proof, at least not without subsequent treatment or coatings, there may also be formed on or sewn to the inner surface of the upper portion, in whole or in part, a lining having one or more desirable properties such as water proofing, flame resistance, wicking or breathing, and other such properties. The lower leg portions 40 sewn to the upper portion 20 along respective seams 50 are in the exemplary embodiment substantially straight annular fabric constructions joined under or along at least one lengthwise inseam panel 60 having one or more studs 62 therealong so as to form leg sections of the pants 10, though it will be appreciated that while the studs 62 do serve a functional purpose, numerous other means of joining leather or other material along a lengthwise edge to form the leg portions 40 may be employed without departing from the spirit and scope of the invention, whereby the studs 62 are to be understood for the purpose of the present invention as being primarily aesthetic. A portion of the inseam panel 60 defines a vent assembly 70, more about which is said below. More generally, again, those skilled in the art will appreciate that the overall construction of both the upper portion 20 and the leg portions 40 is merely illustrative, such that the form and even inclusion of the fly 24 with closure 26 and the waist band 30 with belt loops 32, for example, is not critical to the invention.

Figures 2A, 2B:
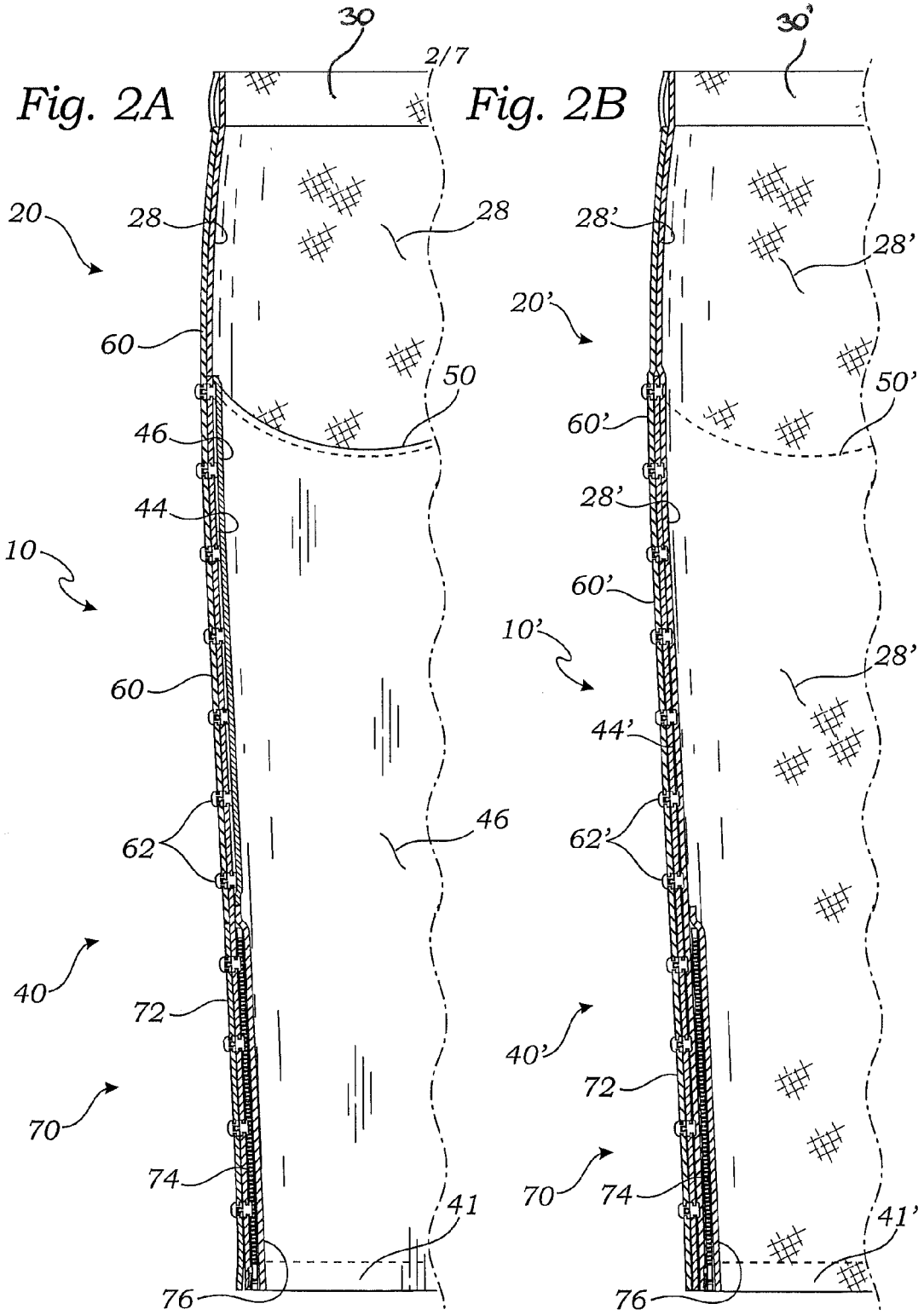
FIG. 2A is a section view thereof.
FIG. 2B is a section view of an alternative exemplary embodiment thereof.

With continued reference to FIG. 1 and now also to FIG. 2A, the construction of the pants 10 may be understood in more detail. Once again, the pants 10 are generally formed by sewing the upper portion 20 and the lower leg portions 40 together along respective seams 50. As shown in the cross-sectional view of FIG. 2A, which entails cutting away one side of the pants 10 and the front along the inseam panel 60 so as to view the back of the right side of the pants, the upper portion 20 includes the upper rear panel 28 sewn underneath the inseam panel 60. In the exemplary embodiment, the upper portion 20 is made of a denim material while the inseam panel 60 is made of leather. While only the upper rear panel 28 is visible in the location where the pants 10 have been sectioned, it will be appreciated that the upper front panel 22 and the upper rear panel 28 may overlap in a conventional inseam stitch beneath the inseam panel 60, or the front and rear panels may be positioned end to end along their marginal edges and there held in place by the inseam panel 60 sewn to each. Similarly, for the lower leg portion 40 sewn to the upper portion 20 along the seam 50, these two fabrics may be brought together and sewn in any manner now known or later developed in the art. And as with the upper portion 20, the formation of the lower leg portion 40 may be achieved by either overlapping the lower front panel 42 and a lower rear panel 44 beneath the inseam panel 60 or by positioning the marginal edges of these panels 42, 44 end to end and then securing them in such position via the continuous inseam panel 60. It will be appreciated that the lower front panel 42 and the lower rear panel 44 forming each leg portion may be a single piece of material cut to the appropriate shape and sewn along a single seam at or beneath the inseam panel 60 running down the outer edge of the leg. Or, the lower front and rear panels 42, 44 may be formed of two pieces of material and so joined along both an outer inseam as shown and described and a separate inseam down the inner leg. Any such inner inseam may be of conventional construction or may be much like the outer inseam shown and described as having an outer inseam panel 60 of leather and, in further detail below, a vent assembly 70. Once more, the lower leg portions 40 may be formed in the exemplary embodiment of leather, though in the particularly embodiment wherein the lower front and rear panels 42, 44 are two separate pieces of material, it will be appreciated that they may be the same type of material or two different types of material depending on the application. For example, the lower front panels 42 may be of a heavy rawhide for increased protection, while the lower rear panels 44 may be of a relatively softer leather or even denim or some other material. Accordingly, those skilled in the art will appreciate that the various upper and lower, front and rear panels can be formed in a variety of shapes, and so be joined along a variety of seams and inseams, and may be formed of a variety of materials without departing from the spirit and scope of the invention. In any case, in the exemplary embodiment shown, studs 62 are installed along the outer inseam panel 60 in the region of the lower leg portion 40 for both aesthetics and to further secure the inseam panel 60 along the lower leg portion 40. As such, the studs 62 pass through both the inseam panel 60 and at least the lower rear panel 44 of the lower leg portion 40. It will be appreciated that the studs could continue along the inseam panel 60 through the upper portion 20 as well, so as to form a pattern all the way down the pants 10 from the waist 30 to the ankle cuff 41, or the studs 62 could be positioned along only a portion of even the lower portion 40. The number of studs 62, or the spacing between the studs 62, is also to be understood as being merely illustrative. With continued reference to FIG. 2A, in the exemplary embodiment wherein the studs are along the inseam panel 60 only in the region of the lower portion 40, or effectively from the horizontal seam 50 joining the upper and lower portions 20, 40 down to the cuff 41 of each leg portion 40, an interior layer 46 is shown as being sewn into the same seam 50 so as to effectively cover the entire inner surface of the lower leg portions 40, whereby the interior layer 46 effectively forms a lining that is potentially in contact with the wearer's skin rather than the lower front or rear panels 42, 44 made of leather or the like. It will be appreciated by those skilled in the art that the interior layer 46 may be formed of a soft or relatively frictionless material such as nylon and so add comfort for the wearer, but is in no way necessary, whether the lower leg portions 40 are constructed of leather or any other material now known or later developed. In addition to providing a barrier between the wearer and the leather or other material from which the leg portions 40 are constructed, it will be further appreciated by those skilled in the art that the interior layer 46 would also prevent the inner surfaces of the studs 62 from contacting the wearer, which may be relatively cold, hard, rough or otherwise not as comfortable against the skin. In the vicinity of the vent assembly 70 formed at the lower end of each leg portion 40, an interior panel 76 may instead be what is positioned between the wearer and, in the case of the vent assembly 70, a closure means 74 such as a zipper. At the outside of the vent assembly 70, a cover panel 72 is formed to selectively cover the zipper 74, more about which is said below in connection with FIGS. 3 and 4. It will be appreciated that in the exemplary embodiment the interior layer 46 would be sewn about at least three sides of the interior panel 76 so as to form a substantially continuous interior surface closest to the wearer that together serves as a barrier between the wearer and the mechanical components of the pants 10 such as the studs 62 and the zipper 74. As also explained more fully below, the interior panel 76 may be constructed of a mesh material, a perforated leather, or any other such breathable or ventilating material now known or later developed. Depending on the type of selectively openable closure means that is incorporated into the vent assembly 70, it will be further appreciated that an interior panel 76 may not be employed at all, and instead the interior layer 46 may come right up to or even cover the interior surface of the closure means. As such, those skilled in the art will again appreciate that numerous constructions of the pants of the present invention are possible without departing from its spirit and scope, so that the constructions shown and described are to be understood as merely illustrative of the principles of the invention.

Turning now to FIG. 2B there is shown an alternative exemplary embodiment of the pants 10' of the present invention again comprising an upper portion 20' and a lower leg portion 40' sewn together along a seam 50'. Here, rather than having a separate interior layer 46 (FIG. 2A), the upper rear panel 28', and effectively the material of the entire upper portion 20', extends the full length of the pants 10' from the waist 30' to the ankle cuff 41'. In the exemplary embodiment wherein the material of the upper portion 20' is denim, it will thus be appreciated that such denim is immediately against the skin, or otherwise closest to the wearer, throughout virtually the entire inner surface of the pants 10'. The lower portion 40' of the pants 10' would still comprise at least one outer, lower panel 44' of leather or the like. In this example, then, in the region of the lower leg portion 40' the inseam comprises the union of the upper rear panel 28' with the lower rear panel 44', with the inseam panel 60' then covering both to complete the inseam construction. Once more, the studs 62' may pass through both the inseam panel 60' and the lower leg portion 40'. In the exemplary embodiment, the studs 62' are buried at their base in the denim material of the upper rear panel 28' so as to not pass all the way through this panel 28', whereby a separate interior layer is not needed. However, those skilled in the art will appreciate that the studs 62' may pass all the way through the entire inseam, with or without an interior layer then being employed in the alternative exemplary embodiment of the pants 10'. While in the exemplary embodiment a lower front panel (not shown) and a lower rear panel 44' of leather may be sewn over the respective upper front and rear panels 22', 28' to form the lower portion 40', whereby the pants 10' are generally formed by sewing one or more appropriately-configured leather panels over what is effectively a pair of jeans, it will be appreciated that any configuration or combination of such panels 44' may be employed and so sewn onto the upper portion 20' to form the pants 10'. For example, only a lower front panel of leather may be sewn over each upper front panel (not shown) to form the respective lower leg portions 40', such that with no such lower rear panel the back of the pants 10' would then look and feel essentially like a pair of jeans. In other words, an alternative exemplary embodiment of the present invention may entail a combination pants and chaps garment in a more literal sense, with the chaps portion being permanently affixed to the front of the pants. For the purpose of the alternative exemplary embodiment of FIG. 2B, the vent assembly 70 is essentially constructed as previously, with a cover panel 72, a zipper 74, and an interior panel 76.

Figure 2C:
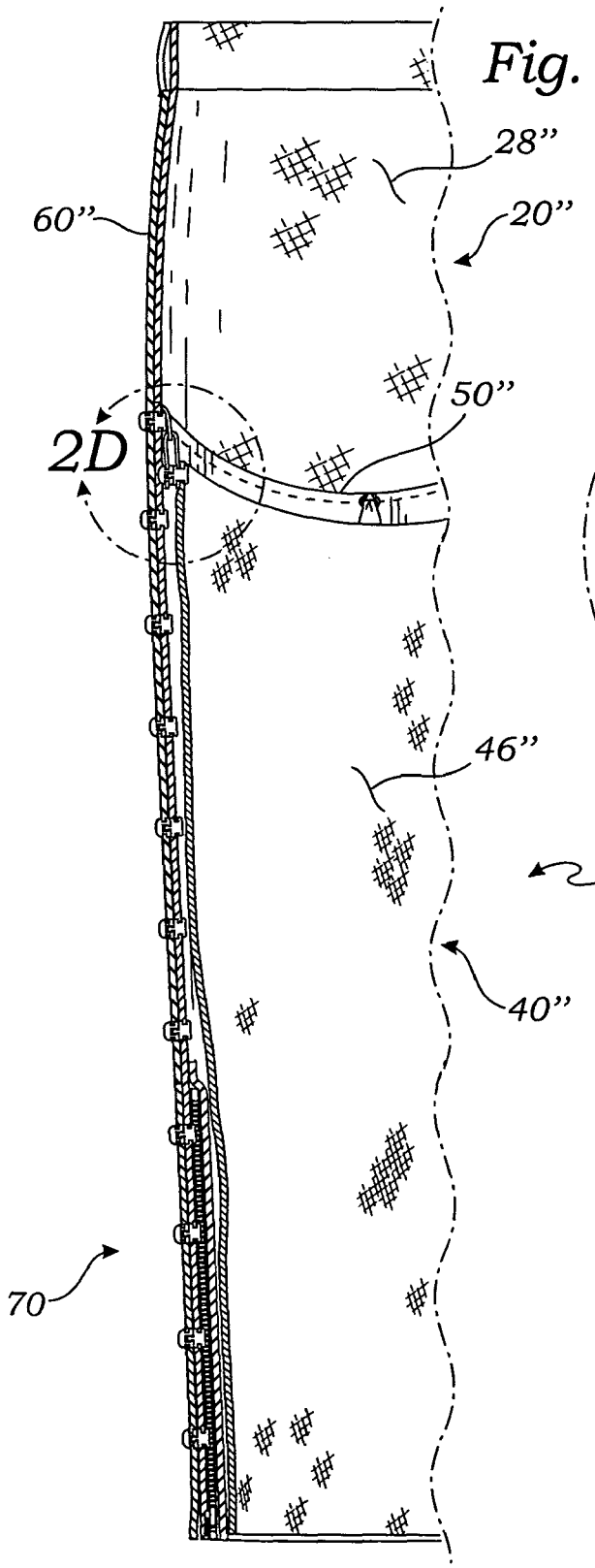
FIG. 2C is a section view of an alternative exemplary embodiment thereof.
Figure 2D:
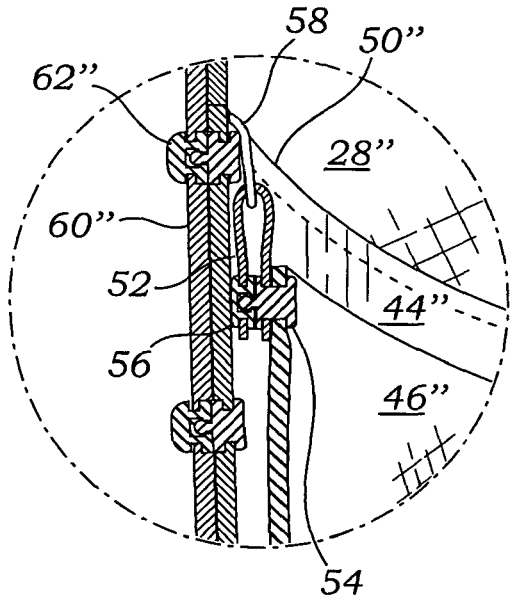
FIG. 2D is an enlarged partial section view of taken from circle 2D of FIG. 2C.

Referring now to FIGS. 2C and 2D, there is shown yet another alternative embodiment of the pants 10" of the present invention again comprised generally of an upper portion 20" and a lower portion 40" joined along a seam 50". Moreover, here, as in the exemplary embodiment of FIG. 2A, the upper portion 20" is joined with the lower portion 40" in the region of the seam 50" with little to no overlap, such that the pants 10" are effectively a single layer along their entire length: denim upper and leather legs, with the inseam panel 60" still running along the entire outer seam. Unlike FIG. 2A, in the exemplary embodiment of FIG. 2C, there is no interior layer 46 (FIG. 2A) sewn along the inside surface of the pants 10" so as to form a lining covering the leather lower portions 40" and, specifically, the studs 62". Instead, now a removable inner lining 46" is inserted in each leg as shown. The lining 46" may be formed of any material or combination of materials now known or later developed to provide warmth or insulation, wicking or breathable properties, further abrasion protection or padding against impact, or any combination thereof. In the exemplary embodiment, the lining 46" is a thermal layer that may be selectively inserted within each leg portion 40" for added warmth and comfort, particularly when the pants 10" are to be worn in cold weather conditions. With reference to FIG. 2D, an exemplary means of removably installing the lining 46" within the leg portion 40" is shown. Spaced apart about the upper end of the lining 46" are attached a series of selectively openable straps 52, with one end of each strap 52 being permanently attached to the upper end of lining 46", in the exemplary embodiment by means of both stitching (not shown) and a first engagement device 54, and the opposite second end of each strap being formed with a second engagement device 56 configured to selectively engage the first engagement device. Specifically, in the exemplary embodiment, the first engagement device 54 is the male portion of a conventional snap and the second engagement device 56 is the mating female portion of a conventional snap. Those skilled in the art will appreciate that numerous other selective engagement means are possible for the straps 52 without departing from the spirit and scope of the invention, including but not limited to Velcro® hook and loop type fasteners and buttons. Loops 58 are then sewn in spaced apart relationship along the seam 50" between the upper and lower portions 20", 40", or in the cutaway view shown, between the upper rear panel 28" and the lower rear panel 44", so as to substantially correspond to each of the straps 52 about the upper end of each lining 46". In the exemplary embodiment there are four such pairs of straps 52 and loops 58 spaced approximately ninety degrees (90°) apart about the perimeter of each leg portion 40", though it will be appreciated that virtually any number of such pairs is possible in the present invention. In use, it will be appreciated that when each of the straps 52 is disconnected as by disengaging the first engagement device 54 from the second engagement device 56, the free end of each strap 52 may be passed through the corresponding loop 58 sewn within the inner portion of the seam 50". By then snapping, or reengaging, the first and second engagement devices 54, 56, each strap 52 is thus connected to a loop 58. By repeating this process for each strap 52 and loop 58 pair around the inside perimeter of each leg, a lining 46" is thus attached to and suspended within each leg as shown in FIG. 2C. In the exemplary embodiment, the lining 46" so installed hangs vertically substantially down to the cuff 41 or ankle of each leg, or thus covers substantially the entire inner surface of each leg portion 40" from the seam 50 to the cuff 41. When the lining 46" is to be removed for cleaning or based on the needs or preferences of the wearer, each of the straps 52 is then again disconnected from its respective loop 58 by disengaging the first and second engagement devices 54, 56, and the linings 46" are simply removed from the leg portions 40". Again, while a particular configuration of the lining 46" and its selective engagement means of respective linking straps 52 and loops 58 is shown and described, those skilled in the art will appreciate that numerous configurations are possible employing engagement means now known or later developed in the art without departing from the spirit and scope of the invention. Though not shown, with any of the exemplary embodiments of the present invention, one or metal inserts may be sewn or riveted on or within the pants, for example, in the vicinity of the knees or calves. Such metal inserts may be padded or simply secured within the pants so as to be bounded by fabric or other material on both sides, as between the leather and denim in the exemplary embodiment of FIG. 2B.

Figure 3B:
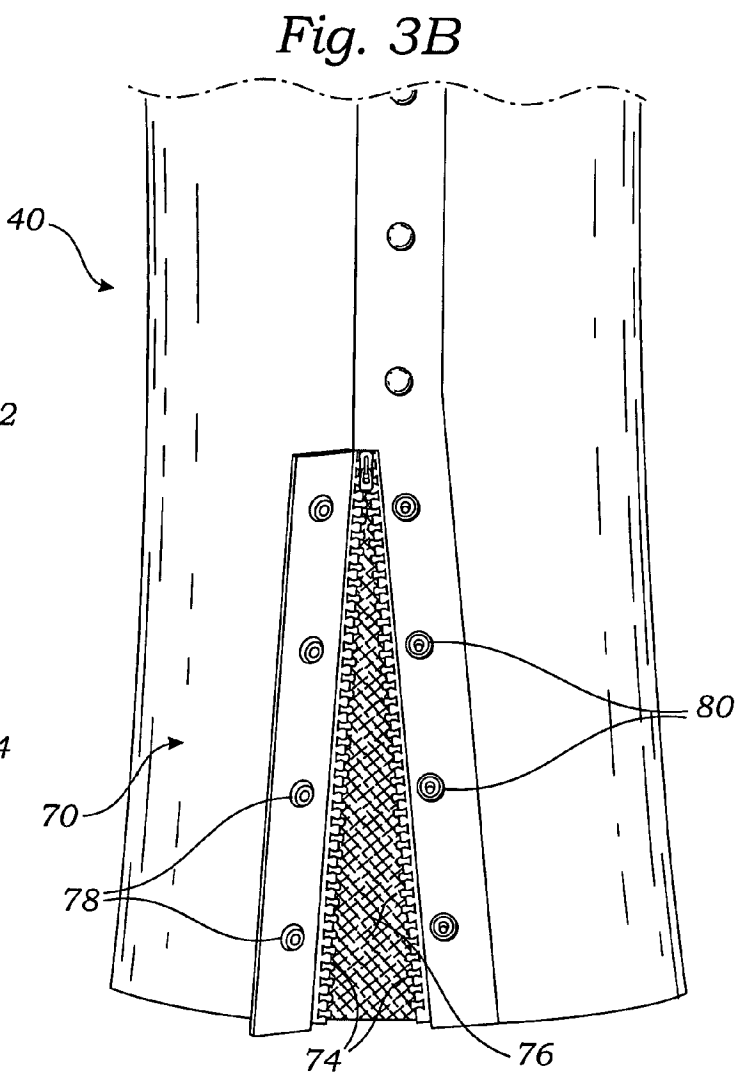
FIG. 3B is the same right side view of the pants of FIG. 3A now with the vent open.
Figure 3A:
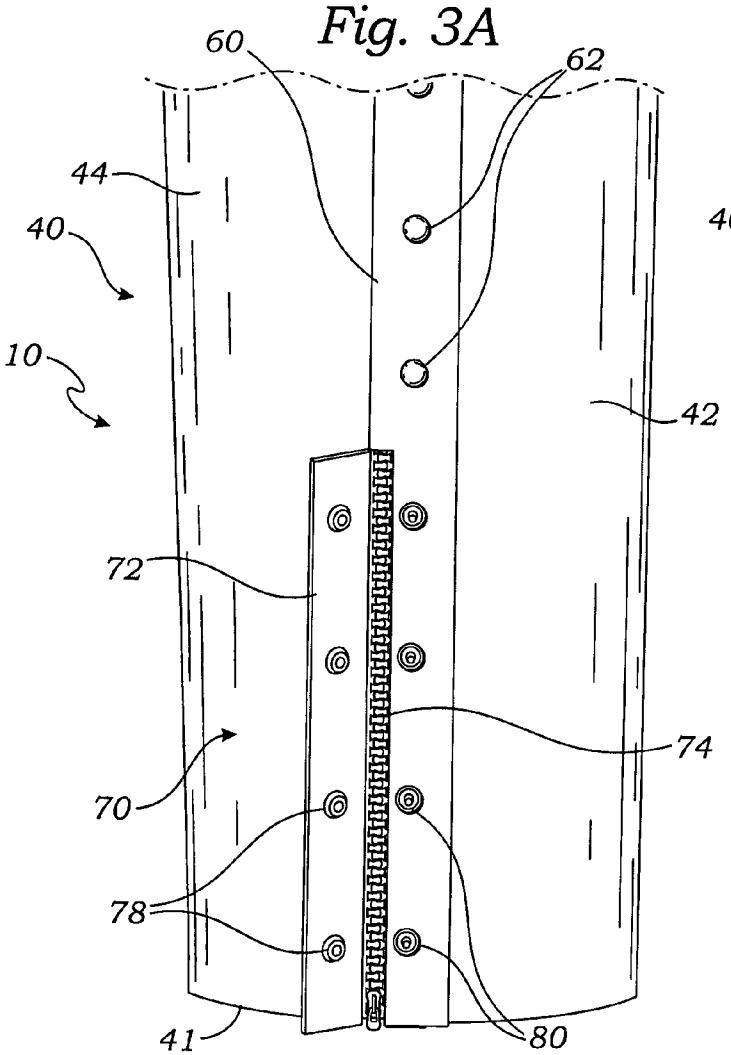
FIG. 3A is an enlarged partial right side view of the pants of FIG. 1 with the vent flap open but the vent still closed.

Turning to FIGS. 3A and 3B, there are shown enlarged partial views of the lower end of the leg portion 40 as viewed from the side, or looking directly at the inseam panel 60 and, particularly, the vent assembly 70. First, in FIG. 3A, the cover panel 72 has been opened to expose the zipper 74. Specifically, it will be appreciated that in the exemplary embodiment the cover panel 72 is formed with a series of spaced apart male snap portions 78 configured to engage corresponding female snap portions 80 sewn, riveted or otherwise affixed to the inseam panel 60, whereby the male and female snap portions 78, 80 may be selectively engaged to secure the cover panel 72 over the zipper 74 and, alternatively, selectively disengaged to allow the cover panel 72 to be folded back or opened as shown to expose the zipper 74. Those skilled in the art will appreciate that while a particular size and configuration of the zipper 74 is shown, this is merely for illustration and a variety of zipper configurations now known or later developed may be employed in one or more of the vent assemblies 70 of the present invention. By way of further example, the zipper may be a seamless waterproof zipper as is known and used in the art in other contexts. Moreover, as above in connection with the selectively linked straps 52 and loops 58 by which the liner 46" is held in place within the leg portions 40" in the alternative exemplary embodiment of FIGS. 2C and 2D, it will again be appreciated by those skilled in the art that numerous engagement means beyond the exemplary snaps are possible in the present invention for the purpose of selectively closing the cover panel 72, including but not limited to Velcro® hook and loop type fasteners and buttons. However, it will be further appreciated that snap-type fasteners are generally preferable particularly in embodiments of the pants 10 of the present invention wherein studs 62 are spaced along the inseam panel 60, whereby the outer portion of the male snap portions 78 formed in the cover panel 72 may be configured to look like the studs 62 and set apart by a spacing similar to the studs 62 so as to give the outer inseam of the pants 10 a continuous appearance therealong. In alternative embodiments of the pants 10 where no studs 62 are employed along the inseam panel 60 it will be appreciated that a closure means for the cover panel 72 of the vent assembly 70 such as Velcro® hook and loop type fasteners may again be preferable as once more providing a continuous appearance along the lengthwise sides of the pants, with the inseam panel 60 and the cover panel 72 essentially blending together or having a similar appearance. Referring now to FIG. 3B, with the cover panel 72 still open, as by the snaps 78, 80 being disengaged, the zipper 74 has now been unzipped from bottom to top to open the vent assembly 70 and expose the interior panel 76 beneath the zipper 74. Once again, the interior panel 76 may be constructed of a mesh material, a perforated leather, or any other such breathable or ventilating material now known or later developed. It will be appreciated that with the vent assembly 70 so opened, fresh air is able to move from outside the pant leg portions 40 to the interior thereof, thereby cooling the wearer's legs. And by spanning the vent opening created by unzipping the zipper 74, the interior panel 76 also serves to maintain the integrity and overall shape of the cuffs 41 of the leg portions 40, which those skilled in the art will appreciate reduces the risk of harm to both the motorcycle and its rider were the free opposite edges of the open vent to be able to flap in the wind. Where the interior panel 76 is made of a perforated leather, a relatively inelastic material, it will be appreciated that the configuration of the cuff 41 or ankle area of each leg portion 40 is further maintained even with the vent assembly 40 partially or fully open. The perforated leather would also offer the necessary breathing while providing abrasion protection, or not compromising the area of the wearer's legs directly beneath the vent assembly 70 even when it is opened. It will be further appreciated that by having the cover panel 72 open in the direction shown, from the front of each leg portion 40 toward the rear, as the wearer rides a motorcycle, horse, or other such transportation, the wind force generated in a direction from the front of the leg toward the back will serve to help keep the cover panel 72 open, whereby the cover panel 72 acts as an air foil collecting and directing at least a portion of the moving air into the vent, further improving the ventilation and cooling of the wearer's legs. While the vent assembly 70 is shown and described as being located along the inseam panel 60 and as having a certain size and shape, it will be appreciated by those skilled in the art that numerous other configurations and locations of one or more of the vent assemblies 70 may be employed without departing from the spirit and scope of the invention. For example, the vent assembly 70, may be longer, may be placed anywhere along the inseam panel 60 even up to the thigh area, may be placed in multiple locations along the inseam panel 60, such as both the calf area and the thigh area, or may be placed anywhere else along the pants, or any combination thereof. Specifically, it will be appreciated that by moving one or more of the vent assemblies 70 from the inseam area around more to or toward the front of the legs, different wind flow or air intake into the interior of the pants 10 can be achieved. Accordingly, once more, any number of variations and combinations of the vent assembly 70 within the pants of the present invention are possible without departing from its spirit and scope.

Figure 4B:
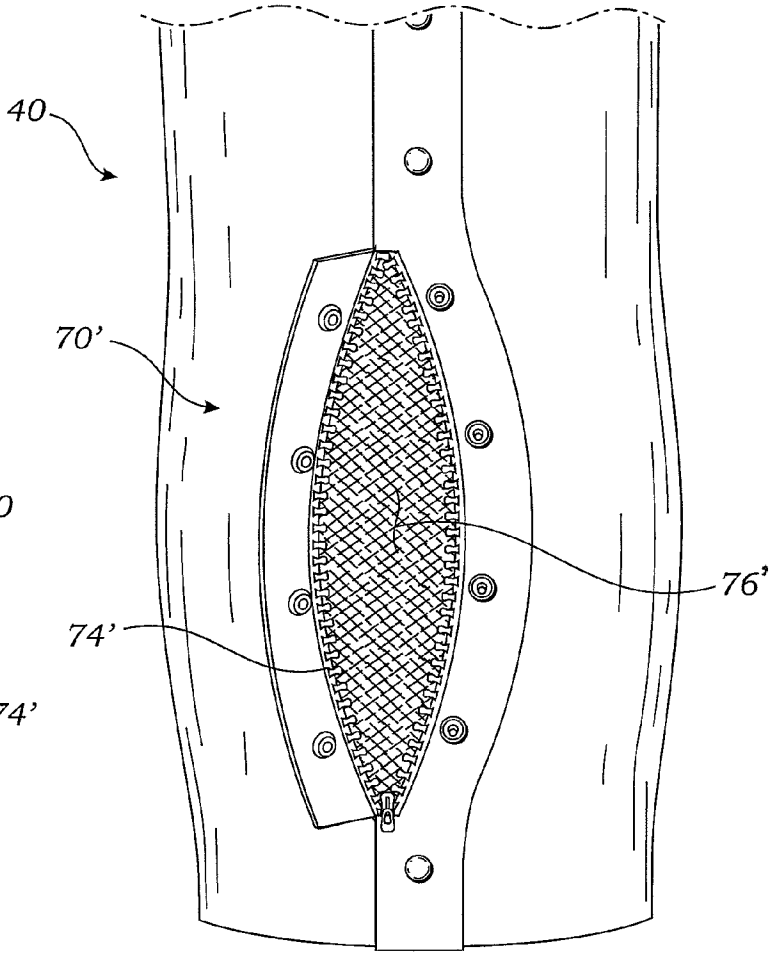
FIG. 4B is the same right side view of the pants of FIG. 4A now with the vent open.
Figure 4A:
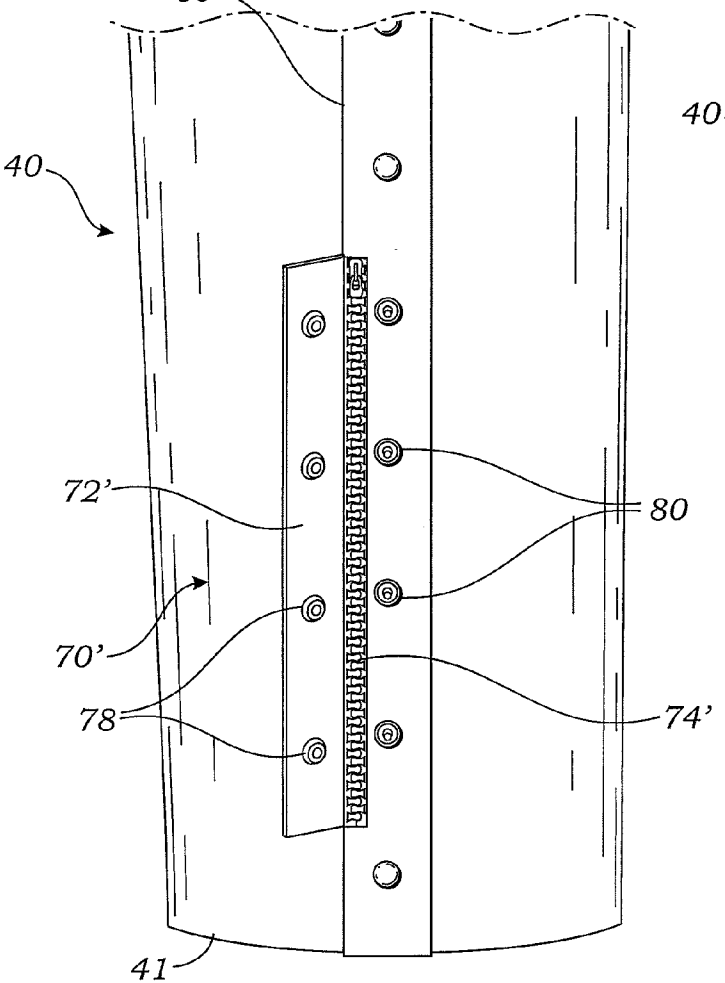
FIG. 4A is an enlarged right side view of an alternative exemplary embodiment of the invention with the vent flap open but the vent still closed.

Similarly, turning now to FIGS. 4A and 4B, there is shown an alternative exemplary embodiment of the vent assembly 70' wherein the entire assembly, and particularly the zipper 74' is shifted slightly up the leg portion 40 so as to not intersect the far end, or the ankle cuff 41, of the leg. As such, when both the cover flap 72' is opened and the zipper 74' unzipped, as shown in FIG. 4B, the vent now opens to expose the interior panel 76' in a substantially oval shape. It will be appreciated that in this way the integrity and shape of the lower leg portion 40 in the vicinity of the ankle, or at the cuff 41, is essentially unaffected by the vent assembly being opened and closed. And this would be true whether the zipper 74' opened top to bottom as shown or bottom to top. In all other respects, the vent assembly 70' of FIG. 4B operates substantially the same as that of FIG. 4A, including the orientation of the cover panel 72' so as to serve as an air foil and catch and direct air into the vent and the construction of the interior panel 76' so as to be breathable and thereby allow for sufficient ventilation of the wearer's legs. In the alternative embodiment of the vent assembly 70' of FIG. 4B wherein the cuff of each leg portion 40' is, again, virtually unchanged by the opening of the vent, it will be further appreciated that the interior panel 76' may be formed of a less substantial, relatively more open, and even elastic material, such as a cotton based mesh or the like, without compromising the functionality of the pants of the present invention. Those skilled in the art will also appreciate that a similar result may be achieved even in the embodiment of FIG. 4A if the zipper 74 were to be unzipped from top to bottom instead of bottom to top. While a particular size and shape of the vent assemblies 70, 70' of the present invention have been shown and described, it will also be appreciated that numerous other configurations, whether as single, larger vents or even multiple vents along a single inseam, are possible without departing from the spirit and scope of the present invention.

In use, again, when a pair of pants 10 according to aspects of the present invention is worn, it will be appreciated that ventilation of the wearer's legs is easily accomplished by opening the cover panel 72 of each vent assembly 70 formed in the lower portion 40 of the pants 10 to expose the means for selectively closing the vent assembly, namely, in the exemplary embodiment, a zipper 74. With the zipper 74 so exposed, it may conveniently be unzipped to then expose the perforated or breathable interior panel 76 and so cool the wearer's legs by allowing fresh air to flow through the perforations and into the space beneath the leg portions of the pants 10. It will be appreciated that while opening or closing the vent assembly 70 may be accomplished while the pants 10 are being worn, such adjustments to the vent may also be made before or after the pants 10 are worn. Similarly, the insertion or removal of the lining 46" may also be performed as above-described with the pants 10 on or off, though here it will be appreciated by those skilled in the art that for a number of reasons it may be more expeditious to do so when the pants 10 are not being worn. In either case, with the vent assembly and the lining, alone or in combination, it will be further appreciated that the pants 10 of the present invention operate to provide the wearer numerous functional advantages as related to helping the wearer maintain a desired temperature and so wear the pants more comfortably in a variety of weather conditions and activities. Specifically, the one or more vent assemblies 70 generally may be operated to selectively cool or warm the legs of the wearer depending on whether the vent is open or closed, respectively, in whole or in part. Other factors such as the size of the vent in length or width and the size and number of perforations formed in the interior panel 76 will further impact particularly the cooling function of the vent assembly 70 when opened at least partially. Accordingly, once more, those skilled in the art will appreciate that a variety of vent configurations are possible without departing from the spirit and scope of the present invention. Likewise, a variety of lining 46 configurations, whether permanent or removable, are possible as well. Particularly, depending on whether the lining 46 is to provide primarily warmth or protection, design choices relating to the permanency of the lining 46 and the material from which it is constructed in large part will follow. While a primary role for the lining 46 would be warmth, in which case it may be preferable that the lining 46 be removable and be formed of a thermally insulating material or materials, it will be appreciated that the lining 46 may also help in cooling by being formed of a wicking and breathable material that would actually help cool the wearer while pulling moisture away from the skin. Or, where the lining 46 is also to serve a protective function, as against impact, abrasion, or even fire, it will be appreciated that the lining 46 may be constructed in such a way as to dampen forces, be particularly tear or puncture resistant, or even be flame resistant. Relatedly, the outer surface of particularly the lower portion 40 of the pants, or the lower front and rear panels 42, 44, may be again be formed of any suitable leather or other such material having the desired protective, weather-resistant, comfort, flexibility and other such factors, whereby those skilled in the art will appreciate that a variety of materials, alone or in combination, may be employed within the spirit and scope of the invention. Thus, in use, once more, based on the weather and the wearer's planned activity, and based on the particular embodiment of the pants 10 to be worn, the wearer may remove or add the lining 46 as appropriate and then put on the pants 10 in a conventional manner. Then, at any point, depending again on the wearer's activities and the weather condition, the vents may be quickly and conveniently opened or closed to suit the wearer's needs, without having the take the pants on and off again.

Figure 5:
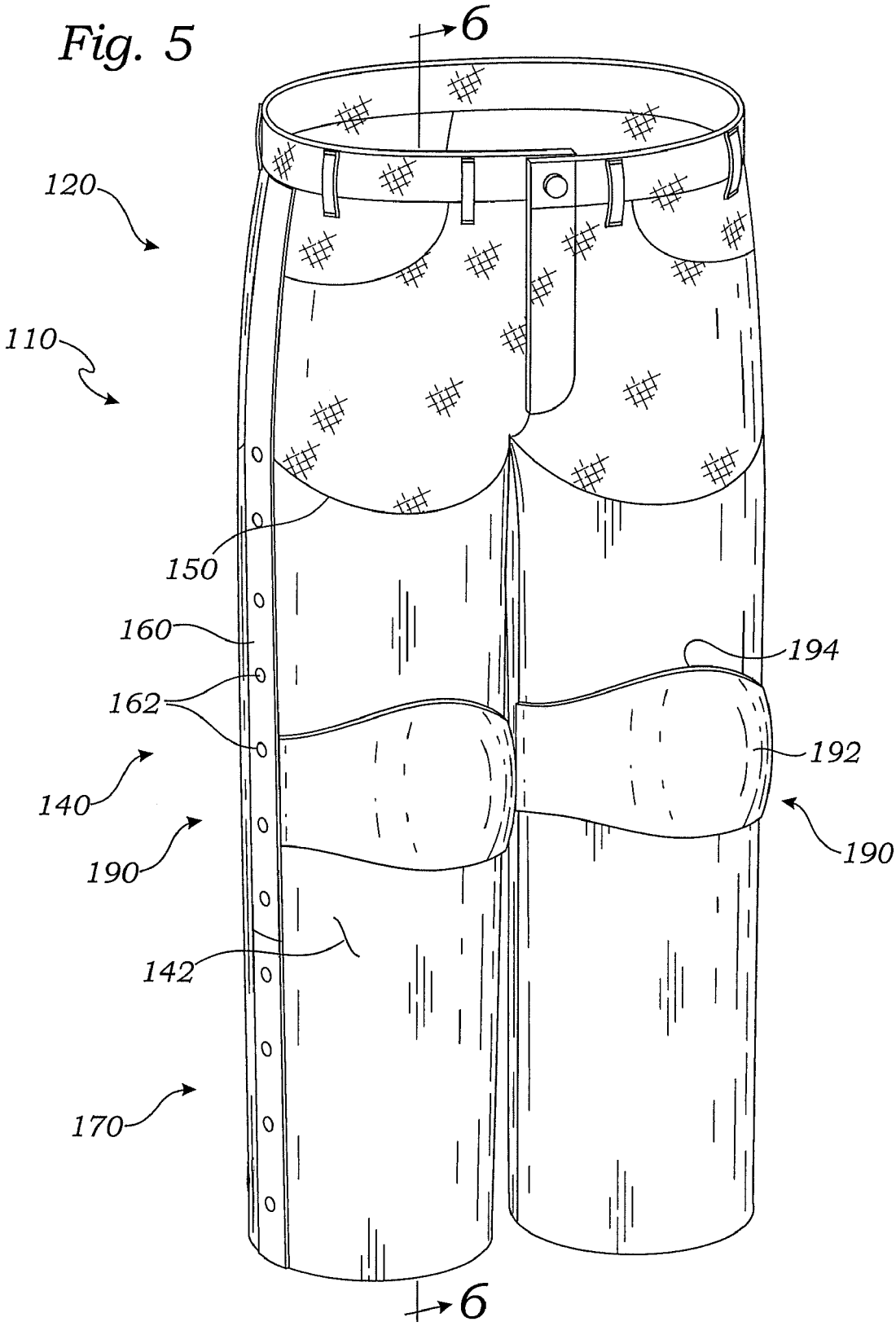
FIG. 5 is a perspective view of an alternative exemplary embodiment of the invention.
Figure 6:
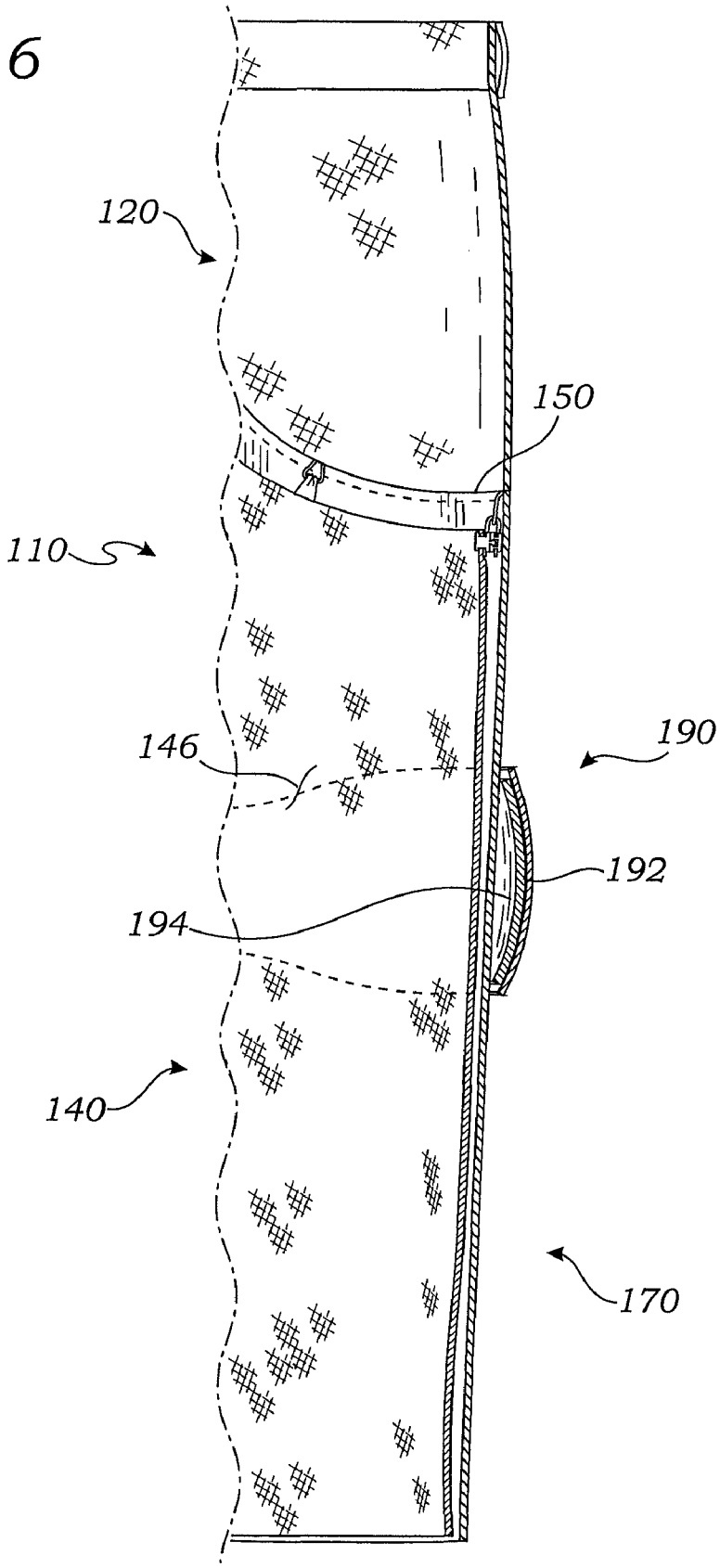
FIG. 6 is a section view thereof.

Turning now to the alternative exemplary embodiment shown in FIGS. 5 and 6, the pants 110 may again be generally constructed of an upper portion 120 and a lower portion 140 joined along seams 150. The pants 110 may also again include an inseam panel 160 interconnecting the upper and lower portions 120, 140 along the outer inseam, though as will be appreciated from above, this construction is not necessary. Similarly, the vent assembly 170 is once again shown at the lower leg near the ankle but may be located virtually anywhere on the pants 110. In the alternative embodiment, now added to the pants 110 are protective armor 190, here shown as knee guards configured to be joined as by rivets 162 at the marginal edges of the armor 190 along or beneath the inseam panel 160 and the opposite inner leg inseam. It will be appreciated by those skilled in the art that numerous other configurations and locations of the protective armor 190, such as shin guards, thigh guards, or the like, may be incorporated into pants 110 according to the present invention without departing from its spirit and scope. Moreover, it will be appreciated that such armor may separately be configured on pants of more conventional construction such as not necessarily having dual material construction, a vent assembly or a liner at all. With continued reference to FIG. 6, in the exemplary embodiment shown, the protective armor 190 so installed on the lower portion 140 of the pants 110 effectively forms in that region four layers of protection. The outermost layer comprises the armor shell 192, which may be formed of any suitable material such as nickel-plated aluminum or stainless steel, likely on the order of 1/16" to 3/32" thick, though it will be appreciated that a variety of materials and thicknesses are possible. Underneath the shell 192, between the shell 192 and the outer surface of the front panel 142 of the lower portion 140, there is formed a pad 194. The pad 194 is to be of sufficient materials and construction to further protect the wearer and provide an extra barrier between the wearer and the relatively rigid shell 192. It will be appreciated that the pad 194 will not only offer protection and comfort, but will also effectively serve to take up some of the variance between wearers of slightly different size and build within a particular nominal pants size. The pad 194 may, for example, be constructed of a high-density foam or a memory foam on the order of 1/8" to 3/8" thick as are known and used in the art in other contexts, though it will be appreciated that virtually any such material now known or later developed may be employed without departing from the spirit and scope of the invention. The pad 194 may be installed on the inside surface of the shell 192, as by any suitable adhesive or the like, may be sewn or riveted in place along with the shell 192 when the protective armor 190 is installed on the pants 110, or may simply "float" between the shell 192 and the front panel 142 of the lower portion. In this way, the pad may be replaced or substituted as needed. In the exemplary embodiment, the fourth layer then protecting the wearer in the vicinity of the protective armor 192 is the interior lining 146 of the pants 110, whether permanent or removable as in the embodiment shown. Once more, those skilled in the art will appreciate that a number of other configurations of the pants 110, and the protective armor 190, particularly, are possible without departing from the spirit and scope of the invention, such that the exemplary embodiment of FIGS. 5 and 6 is to be understood as being merely illustrative of the concept and principles and that the invention is not so limited While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A pants apparatus comprising:

an upper portion formed of a first material, a lower portion formed of a second material, and an inseam panel sewn along at least one lengthwise edge of the pants apparatus spanning both the upper portion and the lower portion;

the upper portion comprising an upper front panel and an upper rear panel sewn together to form a seat section;

the lower portion comprising two lower front panels and two lower rear panels, each lower front panel being sewn to a respective lower rear panel so as to form one of two leg sections, each of the leg sections being sewn to the seat section along at least one seam substantially horizontal with a slight downward curve from the inseam panel toward a groin section of the pants apparatus and at least one vent assembly is installed in each lower portion, each vent assembly comprising a means for selectively closing the vent assembly formed integrally with the lower portion; a cover panel formed so as to selectively cover the closure means; and an interior panel formed beneath the closure means and configured with perforations to allow air to pass therethrough upon opening of the closure means.

2. The apparatus of claim 1 wherein:

the first material is denim; and the second material is leather.

3. The apparatus of claim 2 wherein the leather is selected from the group consisting of rawhide, suede, deerskin, elk skin, pigskin and sheepskin.

4. The apparatus of claim 1 wherein:

the upper front panel, the upper rear panel and the lower rear panels are constructed of denim; and the lower front panels are constructed of leather.

5. The apparatus of claim 1 wherein the closure means is a zipper.

6. The apparatus of claim 1 wherein the interior panel is formed of a perforated leather.

7. The apparatus of claim 1 wherein:

each lower portion terminates in a cuff; and the vent assembly is spaced from the cuff.

8. The apparatus of claim 1 wherein at least one vent assembly is installed substantially along the inseam panel.

9. The apparatus of claim 8 wherein the cover panel is formed with male snap portions configured to engage corresponding female snap portions formed along the inseam panel opposite the closure means, whereby the closure means is selectively and securably covered by the cover panel.

10. The apparatus of claim 9 wherein:

studs are installed spaced along the inseam panel;

the male snap portions are configured to substantially resemble the studs and are spaced along the cover panel substantially equal to the spacing of the studs; and the width of the inseam panel is substantially equal to the width of the cover panel, whereby the appearance of the pants apparatus along each lengthwise edge is substantially continuous.

11. The apparatus of claim 9 wherein the cover panel is installed over the closure means so as to selectively open from front to back, whereby the cover panel functions as an air foil to direct moving air into the vent assembly.

12. The apparatus of claim 1 wherein:

each lower portion terminates in a cuff; and the vent assembly substantially intersects the cuff.

13. The apparatus of claim 1 wherein the cover panel is installed over the closure means so as to selectively open from front to back, whereby the cover panel functions as an air foil to direct moving air into the vent assembly.

14. The apparatus of claim 1 further comprising a lining installed substantially beneath the lower portion.

15. The apparatus of claim 14 wherein:

the lining is formed about an upper end with at least two spaced-apart, selectively openable straps, a first end of each strap being attached to the upper end of the lining;

a first engagement device is attached to the strap at the first end;

an opposite second end of each strap is formed with a second engagement device configured to selectively engage the first engagement device; and at least two loops are sewn in spaced apart relationship along the seam between the upper portion and the lower portion, whereby each strap may be passed through the corresponding loop and the first and second engagement devices engaged to removably attach the lining to the pants apparatus and substantially suspend the lining within the lower portion.

16. The apparatus of claim 1 further comprising protective armor installed substantially adjacent to the lower portion.

17. The apparatus of claim 1 wherein:

the upper front panel and the upper rear panel are constructed of denim; and the lower front panels and the lower rear panels are constructed of leather.

18. A pants apparatus comprising:

an upper portion formed of a first material a lower portion formed of a second material and connected to the upper portion along at least one seam;

an inseam panel sewn along at least one lengthwise edge of the pants apparatus spanning both the upper portion and the lower portion; and a lining installed substantially beneath the lower portion, wherein:

the lining is formed about an upper end with at least two spaced-apart, selectively openable straps, a first end of each strap being attached to the upper end of the lining;

a first engagement device is attached to the strap at the first end;

an opposite second end of each strap is formed with a second engagement device configured to selectively engage the first engagement device; and at least two loops are sewn in spaced apart relationship along the seam between the upper portion and the lower portion, whereby each strap may be passed through the corresponding loop and the first and second engagement devices engaged to removably attach the lining to the pants apparatus and substantially suspend the lining within the lower portion.

19. A pants apparatus comprising:

an upper portion formed of a first material a lower portion formed of a second material and connected to the upper portion along at least one seam;

an inseam panel sewn along at least one lengthwise edge of the pants apparatus spanning both the upper portion and the lower portion, wherein the width of the inseam panel is substantially equal to the width of the cover panel and studs are installed spaced along the inseam panel; and at least one vent assembly installed in each lower portion, with at least one vent assembly being installed substantially along the inseam panel, each vent assembly comprising:

a means for selectively closing the vent assembly formed integrally with the lower portion;

an interior panel formed beneath the closure means and configured with perforations to allow air to pass therethrough upon opening of the closure means; and a cover panel formed so as to selectively cover the closure means, wherein the cover panel is formed with male snap portions configured to substantially resemble the studs and spaced along the cover panel substantially equal to the spacing of the studs along the inseam panel, the male snap portions further configured to engage corresponding female snap portions formed along the inseam panel opposite the closure means, whereby the closure means is selectively and securably covered by the cover panel and the appearance of the pants apparatus along each lengthwise edge is substantially continuous.

* * * * *